US008551268B1

(12) United States Patent
Yalamanchili et al.

(10) Patent No.: US 8,551,268 B1
(45) Date of Patent: Oct. 8, 2013

(54) ELECTRIC PRIMER

(75) Inventors: Rao Yalamanchili, Flanders, NJ (US); John Hirlinger, Hackettstown, NJ (US); Christopher Csernica, Port Murray, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/550,751

(22) Filed: Aug. 14, 2012

Related U.S. Application Data

(62) Division of application No. 12/983,970, filed on Jan. 4, 2011, now Pat. No. 8,277,585.

(51) Int. Cl.

| | |
|---|---|
| ***C06B 45/00*** | (2006.01) |
| ***C06B 33/00*** | (2006.01) |
| ***D03D 23/00*** | (2006.01) |
| ***D03D 43/00*** | (2006.01) |

(52) U.S. Cl.
USPC ..... 149/109.4; 149/2; 149/37; 149/108.2; 149/108.6

(58) Field of Classification Search
USPC ..... 149/2, 37, 108.2, 108.6, 109.2, 109.4
See application file for complete search history.

(56) References Cited

U.S. PATENT DOCUMENTS

| | | | | |
|---|---|---|---|---|
| 2,481,795 | A * | 9/1949 | Taylor et al. | 149/47 |
| 2004/0016483 | A1 * | 1/2004 | Filho | 149/64 |
| 2005/0189053 | A1 * | 9/2005 | Pile et al. | 149/108.6 |
| 2009/0301337 | A1 * | 12/2009 | Wilson et al. | 102/364 |

* cited by examiner

*Primary Examiner* — James McDonough
(74) *Attorney, Agent, or Firm* — Henry S. Goldfine

(57) ABSTRACT

Improved electric primer compositions, structures, and methods that are compatible with existing munitions and in particular an exemplary electric primer composition including carbon nanotubes along with energetic primer mixture(s) and an exemplary primer structure including layers of energetic materials wherein a layer exhibiting the most energetic character is positioned proximate to a primer button. Alternative embodiments include both conductive and non-conductive layers.

10 Claims, 2 Drawing Sheets

ELECTRIC PRIMER

CROSS REFERENCE TO RELATED APPLICATION

This application is a divisional application of currently parent U.S. patent application Ser. No. 12/983,970, filed Jan. 4, 2011 now U.S. Pat. No. 8,277,585, and further, the parent Ser. No. 12/983,970 application is incorporated herein, as if set forth in its entirety.

U.S. GOVERNMENT INTEREST

The inventions described herein may be manufactured, used and licensed by or for the U.S. Government for U.S. Government purposes.

FIELD OF THE DISCLOSURE

This disclosure relates generally to the field of munitions. More particularly, it pertains to an improved electric primer for use with—for example—munitions including artillery.

BACKGROUND OF THE DISCLOSURE

The proper functioning of countless varieties of munitions depends upon the reliable initiation of an explosive train. Initiating devices, e.g., primers, are employed in nearly all such munitions.

Given their pervasiveness, improvements to primer structures, primer materials, primer performance and/or environmental impact of primers are of considerable interest and would represent a significant advance in the art.

SUMMARY OF THE DISCLOSURE

Such an advance in the art is made according to an aspect of the present disclosure directed to improved primer compositions and preparative methods. Advantageously, improved compositions, structures, and methods according to the present disclosure are compatible with existing munitions thereby facilitating their adoption.

Viewed from a first aspect, the present disclosure is directed to an improved, electrically conductive primer composition employing carbon nanotubes and/or carbon black and/or acetylene black along with energetic primer mixture (s).

Viewed from another aspect, the present disclosure is directed to methods for preparing the electrically conductive primer compositions and further methods for preparing primers from the compositions.

Viewed still another aspect, the present disclosure is directed to a primer structure including multiple layers of energetic components wherein the layer exhibiting the most energetic characteristic is placed nearest to a primer button. In further embodiments, the multiple layers include both conductive layers and non-conductive layers within the primer structure such that the conductive layer is in close proximity to the primer button while additional energetic material layers overlay the conductive layer.

Advantageously, compositions, structures and methods according to the present disclosure interoperate with a number of existing primer and cartridge hardware thereby facilitating quick adoption while minimizing expenses associated with alternative new designs. Additionally, compositions, structures and methods according to the present disclosure permit the use of common components across different munitions systems

BRIEF DESCRIPTION OF THE DRAWING

A more complete understanding of the present disclosure may be realized by reference to the accompanying drawings in which.

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

By way of some additional background, it is noted that contemporary primers are generally either of an electrical type or a percussion type and both types are used in a variety of munitions including medium caliber artillery. As may be appreciated, electrical primers are initiated by an electrical current while percussion primers are initiated by a mechanical shock. Advantageously, primers constructed according to aspects of the present disclosure may be either electrical or percussion type primers.

With respect to electrical primers, they are initiated electrically either by passing an electric current through a bridge wire in contact with an energetic primer mix or through a conductive, energetic primer mix. When such a conductive primer mix is employed there is typically no need for a bridge wire to initiate the primer. By way of specific example only and in no way limiting the present disclosure, contemporary 20 mm munition rounds utilize a conductive mix while 30 mm rounds use a bridge wire.

Figure 1:
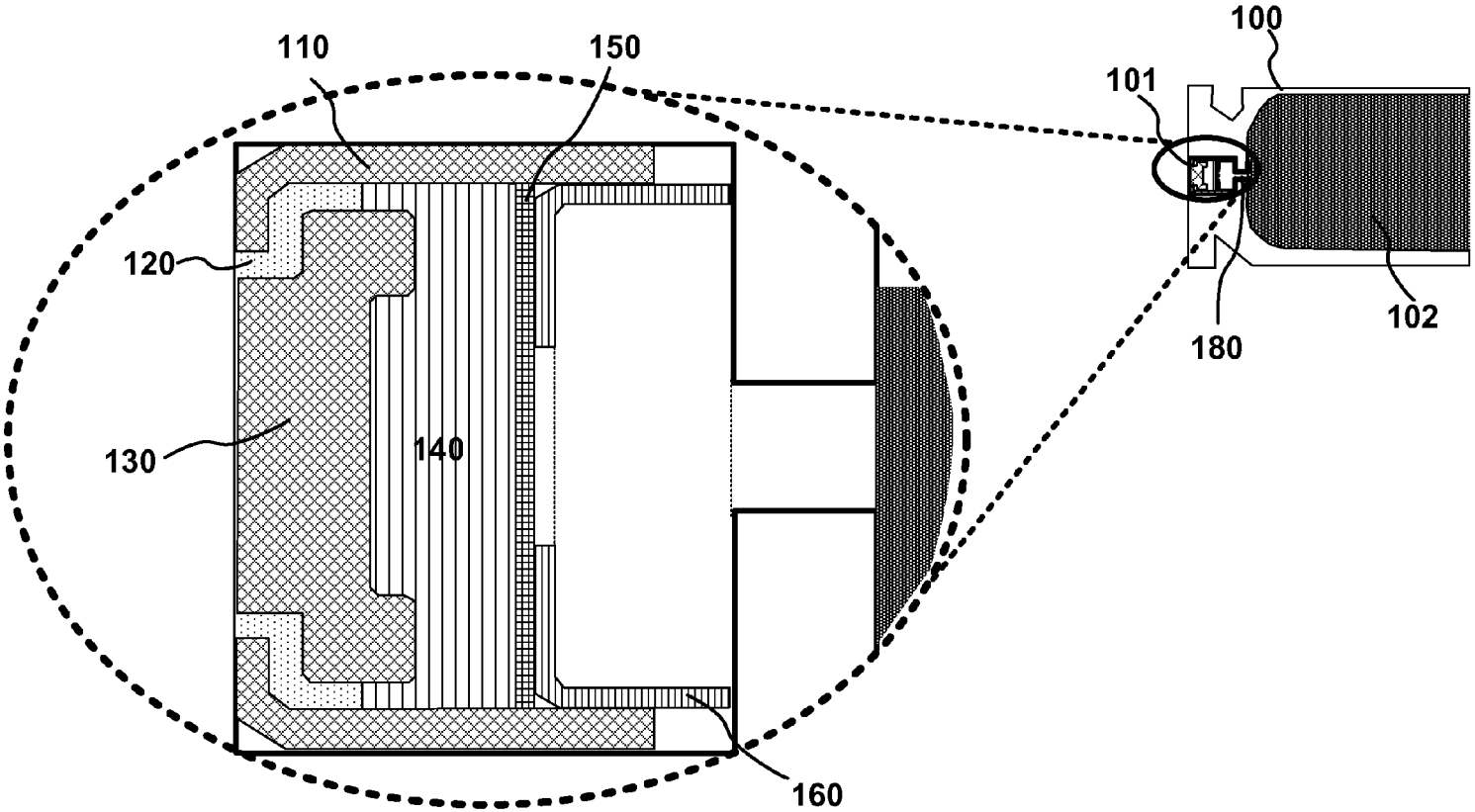
FIG. 1 is a schematic diagram showing a representative primer configuration in cross-section according to an aspect of the present disclosure.

Turning now to FIG. 1 there is shown a schematic cross-sectional view of a representative cartridge case 100 including primer 101 and further details of such primer. As may be observed from that FIG. 1 and generally known to those skilled in the art, the primer 101 is inserted into a base of a cartridge casing 100 where it may initiate an explosive train which progresses through a vent hole 180 resulting in the explosion of the propellant 102 causing the ejection of a projectile (not specifically shown) from the casing.

Shown further in that FIG. 1 in the detailed view of the primer 101. As shown in that detailed view, an assembled primer comprises a generally cylindrical primer cup 110 into which is positioned an insulator 120 and a button 130 positioned at a base of the primer 101 such that it is electrically insulated from the primer cup 110 by the insulator 120. Placed within the primer cup and overlying the button is a quantity of conductive energetic material 140 such as that which is one subject of the present disclosure. Overlying the energetic material 140 is a paper disk 150 and a support cup 160 which generally secures the components in place within the primer cup itself.

According to an aspect of the present disclosure, a conductive primer mix is prepared by mixing carbon nanotubes with an energetic primer mix. Alternatively, carbon black and/or acetylene black may be added to the primer mix to provide a suitable conductive characteristic. Generally, 2% to 4% by weight of carbon is required depending upon the particular type of carbon used.

Advantageously the primer mix according to the present disclosure may be prepared in an aqueous process thereby further enhancing its environmental friendliness and minimizing its environmental impact. Such an aqueous process is further advantageous over conventional, non-aqueous processes in that solvent recovery is generally not required for the aqueous process. Accordingly, an exemplary process of preparing an electrically conductive primer mix according to the present disclosure proceeds as follows.

500 mg of Gum Arabic is dissolved in 9.5 ml of distilled water. 500 mg of Ammonium dihydrogen phosphide (ADP) is dissolved in 9.5 ml of distilled water. 170 ml of the ADP solution and 650 ml of the Gum Arabic Solution is added to 1.7 mg of Bi2O3 and mixed vigorously with stirring until homogeneous and all particles fully wetted. To this is added 300 mg of Nano-Aluminum (80 nm) and an additional 350 ml of Gum Arabic Solution followed by vigorous stirring until homogeneous and all particles fully wetted. This homogeneous wetted mix is mixed further by vortex mixer until it exhibits a homogeneous color and is followed by further mixing in a sonicator for approximately 15 minutes which results in an energetic mix.

To this energetic mix is added a sufficient amount/type of carbon to provide the desired electrical conductivity. In a preferred composition, substantially 2.5% by weight carbon nanotubes are added and mixed thoroughly with the energetic mix. In those instances where an additional, secondary explosive such as pentaerythritol tetranitrate (PETN—also known as PENT, PENTA, TEN, nitropenta) are employed, about 222 mg (5% by weight) may be added after 5 minutes of sonication and continued for an additional 10 minutes. The resulting conductive, energetic mix may be placed into primer cups and dried in an oven for 4 hours @ 120 degrees F. which time/temperature may be reduced by drying in a vacuum.

To ensure compatibility with contemporary electric primers, performance comparison studies were performed on the conductive primer mix of the instant disclosure as compared to existing, barium nitrate, lead styphnate and calcium silicide primer compositions. A side by side comparison utilizing varying amounts of conducting primer is indicative of the compatibility.

As may now be appreciated, variations to the conductive primer mix of the present disclosure are possible. By way of example, it is noted that metastable intermolecular composite (s) (MIC)—which comprise nano-aluminum and molbdenenum trioxide—may be employed to desirably affect the conductive properties of the primer mix. Since conventional MIC containing molbdenenum trioxide is not amenable to aqueous processing, MIC containing bismuth trioxide (BIC) may be employed as it is compatible with both solvent and aqueous processing.

As those skilled in the art will appreciate, munition characteristics such as action times dramatically affect the overall performance of the munition—particularly those munitions having long and/or large propellant beds and when used at cold temperatures. An understanding of action times is particularly critical when the munition is used in an automatic or high-firing-rate weapon to minimize failures.

For example, too much ullage or empty space in a cartridge or primer may increase ignition delays. As such, it is preferred that much of the primer mix completely burn before the resulting energetic train is permitted to enter a propellant bed. As such, primer mix according to the present disclosure may employ gas producing compositions and/or boosters in addition to the BIC to further enhance its operational characteristics. For example, KDNP (7-hydrosy-4,6-dinitrobenzofuroxan, potassium salt) is a new energetic material which is structurally similar to the well-known primary explosive, KDNP may be employed along with a booster, RDX.

To evaluate these compositions, a parametric study of three groups was performed. The first group contains only BIC and booster, RDX. The second group utilizes a lesser amount of BIC, KDNP and booster. The third group uses a tapered primer button instead of a flat primer button and a lesser amount of BIC KDNP and booster—as was the case with the second group. All three groups were prepared in an aqueous process and primed into standard brass 20 mm cartridge cases—for example the well-known M103 cartridge case.

For our studies, the primed cartridge cases were loaded with a ball propellant from de-milled M55 cartridges and 20 mm steel projectiles were mated to the primed, loaded cartridge cases and crimped. Rounds so prepared according to the present disclosure were conditioned for about 4 hours at a variety of temperatures namely, hot (160F), ambient (70F), and cold (−65F) before testing. Performance specifications were satisfied for each.

Since the same total volume is available within the existing primer hardware and cartridge cases in each of the three groups, the first group contains more BIC (~200 mg) than the other two groups. In each of the three groups, the components are added in layers, with the BIC mixture—which contains the conductive component)~always loaded into the primer first such that it is adjacent to the primer button as layer 1. In each of the three groups, the amount of booster is substantially the same—namely 100 mg.

For the second group of cartridges, layer 1 comprises substantially 100 mg BIC overlying which is substantially 60 mg KDNP as layer 2. With respect to the third group of cartridges, layer 1 comprises substantially 100 mg of BIC as layer 1 and substantially 50 mg of KDNP as layer 2. During preparation, small amounts of acetone or isopropyl alcohol may be used to soften the KDNP thereby resulting in lower friction between particles thereby reducing hazards associated with loading the energetic materials.

Operationally, the three groups exhibited pressure, muzzle velocity and action times agreeable with contemporary industrial rounds. Advantageously, each type of button performed well with our compositions and layered structure(s).

Figure 2:
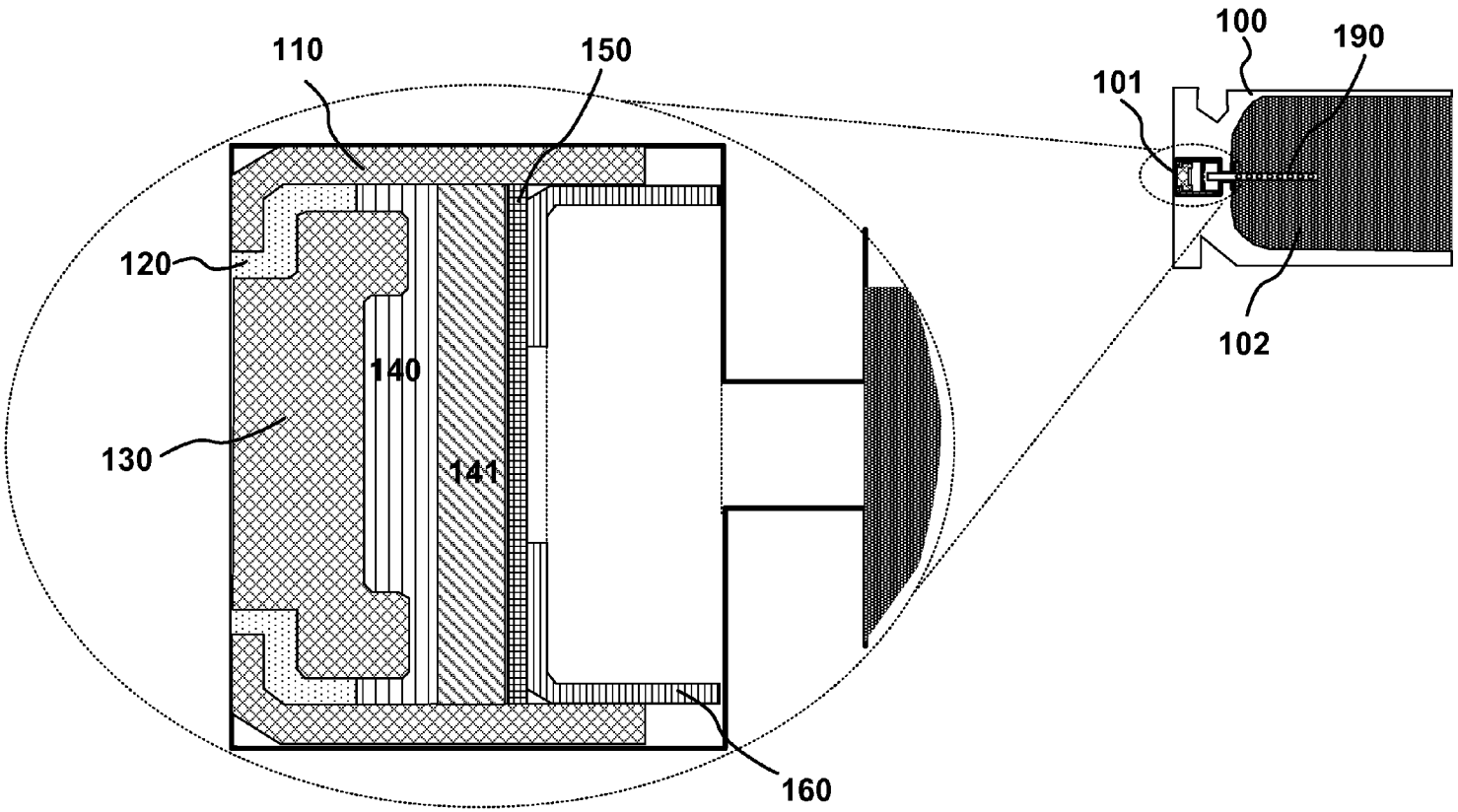
FIG. 2 is a schematic diagram showing another representative primer configuration in cross-section according to an aspect of the present disclosure.

At this point, reference is made to FIG. 2 which shows a schematic diagram cross section of such a layered primer according to an aspect of the present disclosure. Shown in that FIG. 2 is the detailed view of the primer 101 having a layered compositional structure. As shown in that detailed view, the assembled primer comprises a generally cylindrical primer cup 110 into which is placed a quantity of conductive energetic material 140. Overlying the conductive energetic material 140 is a quantity of an additional energetic material 141. As will be described, the two energetic materials are pressed into place under pressure. Overlying the energetic material 141 is a paper disk 150 and a support cup 160, which secures the components in place within the primer cup itself. Shown further is a schematic flash tube 190 which extends from the primer cup area into a quantity of propellant on some munitions.

Given the noted improvements of our layered structures, further studies were conducted in an attempt to improve contemporary industrial rounds. More particularly a highly sensitive, electrically conductive material comprising KDNP and carbon black (~50 mg) was loaded into a primer cup under pressure (~1000 lbs) as layer 1. Overlying this mixture was loaded another mixture layer 2 (~55 mg) under pressure (~1200 lbs), comprising ~26 wt % CL-20 (hexanitrohexaazaisowurtzitane), ~27 wt % iron oxide ($Fe_2O_3$, ~20-50 nm), ~11 wt % nano-aluminum (~50 nm), ~40 wt % KDNP, and trace amounts of isopropyl alcohol. In this formulation, the iron oxide is used instead of bismuth trioxide although either or both could be used. A closure cup was placed on top of the layer 2 and into it was loaded ~110 mg of an energetic mixture comprising ~89 wt % CL-20 and ~11 wt % nano-aluminum (~80 nm). Approximately 65 mg of booster material was placed into a vent hold between the primer so constructed and propellant in ammunition constructed with these primers. Notably, variations in wt % of ~10% do not significantly affect the performance of this composition.

The principles of the present disclosure which have been described with respect to 20 mm ammunition have been applied to 30 mm ammunitions with even more impressive results. As is known, 30 mm ammunition utilize a flash tube to augment the primer and provide an ignition source for propellant. To evaluate the principles of the present disclosure as applied to 30 mm ammunition, rounds with and without flash tubes were constructed. In those rounds with a flash tube, four additional pellets of booster were placed in the flash tube. In those rounds without a flash tube, about 120 mg of booster was placed in a vent hole which is situated between the primer and the propellant. From our tests, additional savings are possible by building rounds without flash tubes according to the present disclosure thereby permitting the utilization of the same components and/or fire control systems across both 20 mm and 30 mm systems which was not done prior to the present disclosure.

At this point, while we have discussed and described the invention using some specific examples, those skilled in the art will recognize that our teachings are not so limited. More particularly, we have shown our primers using particular energetic and conductive compositions. Those skilled in the art will appreciate that variations to the compositions are within the scope of our inventive teachings and in particular bismuth tri-oxide may be replaced by iron oxide. Additionally, our examples have only shown two layers of energetic materials within a primer cup. Additional layers and/or compositions are also within the scope of our inventive teachings. Accordingly, the invention should be only limited by the scope of the claims attached hereto.

The invention claimed is:

1. A primer comprising:

a primer cup;

a quantity of a first energetic primer mix positioned within the primer cup; and a quantity of a second energetic primer mix positioned within the primer cup and overlying the first energetic mix;

wherein said first energetic primer mix is more energetic than the second energetic primer mix;

wherein said first energetic primer mix includes carbon nanotubes for providing an electrical conductive characteristic to said first energetic primer mix.

2. The primer according to claim 1 further comprising:

a primer button positioned within a base of the primer cup;

such that the quantity of the first energetic primer mixes is adjacent to the primer button.

3. The primer according to claim 2 wherein said first and second energetic primer mixes are pre-shaped prior to their positioning within the primer cup.

4. The primer according to claim 2 wherein the positioning of the energetic primer mixes within the primer cup is such that distinct layers of energetic primers are formed and no significant intermixing of the layers occurs prior to initiation.

5. The primer according to claim 1 wherein said first energetic primer mix includes a booster comprising a secondary explosive component.

6. The primer according to claim 1 wherein said first energetic primer mix includes one selected from the group consisting of: bismuth trioxide and iron oxide.

7. The primer according to claim 1 wherein said first energetic primer mix includes KDNP.

8. The primer according to claim 1 wherein said second energetic primer mix includes CL-20.

9. The primer according to claim 1 which is positioned into a munitions round having a quantity of booster positioned in a vent hole between the primer and a quantity of propellant within the round.

10. The primer according to claim 1 which is positioned into a munitions round having a quantity of booster positioned in a flash tube extending from the primer into a quantity of propellant.

* * * * *